US007699628B2

(12) United States Patent
Fan et al.

(10) Patent No.: US 7,699,628 B2
(45) Date of Patent: Apr. 20, 2010

(54) ELECTRICAL CONNECTOR HAVING REINFORCEMENT MEMBER ATTACHED TO HOUSING

(75) Inventors: Chia-Wei Fan, Tu-cheng (TW); Darrell Wertz, Chandler, AZ (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/157,017

(22) Filed: Jun. 6, 2008

(65) Prior Publication Data

US 2009/0305525 A1 Dec. 10, 2009

(51) Int. Cl.
*H01R 12/00* (2006.01)

(52) U.S. Cl. ..... 439/83

(58) Field of Classification Search ..... 439/83, 439/876, 66, 69, 73, 571–577, 71, 74; 228/56.3
See application file for complete search history.

(56) References Cited

U.S. PATENT DOCUMENTS 4,978,315 A * 12/1990 Edgley et al. ..... 439/441
5,242,097 A * 9/1993 Socha ..... 228/56.3
5,519,580 A * 5/1996 Natarajan et al. ..... 361/760
5,620,129 A * 4/1997 Rogren ..... 228/56.3
6,095,400 A * 8/2000 Liu ..... 228/56.3
6,132,245 A * 10/2000 Wertz et al. ..... 439/556
6,196,852 B1 * 3/2001 Neumann et al. ..... 439/66
6,659,795 B1 * 12/2003 Lai et al. ..... 439/526
6,945,788 B2 * 9/2005 Trout et al. ..... 439/66
6,957,964 B2 * 10/2005 Chiang ..... 439/66
6,971,885 B2 * 12/2005 Mowry ..... 439/66
7,179,120 B2 * 2/2007 Hsieh et al. ..... 439/571
7,226,298 B1 6/2007 Minich
2005/0014400 A1 * 1/2005 Liao et al. ..... 439/73

* cited by examiner

*Primary Examiner*—Neil Abrams
*Assistant Examiner*—Harshad C Patel
(74) *Attorney, Agent, or Firm*—Andrew C. Cheng; Wei Te Chung; Ming Chieh Chang

(57) ABSTRACT

An electrical connector (200) adapted for electrically connecting an electronic package with a circuit substrate, comprises an insulative housing (3), a plurality of terminals (4) and a reinforcement member (5). The housing (3) comprising an upper surface (32) for supporting the electronic package and an opposite bottom surface (31) for being mounted to the circuit substrate. The terminals (4) comprising a soldering portion (42) extending beyond the bottom surface (31) of the insulative housing (3) adapted for electrically connecting the circuit substrate, a spring arm (41) with a mating portion (411) extending beyond the upper surface (32) of the insulative housing (3) adapted for electrically connecting the electronic package at a free end thereof. The reinforcement member (5) is made of material different from that of the insulative housing (3) and attached to the bottom surface (31) of the insulative housing (3). When heated, the reinforcement member (5) will not distort together with the insulative housing (3). Thus, the reinforcement member (5) can reinforce the insulative housing (3) to prevent the distortion of the housing (3).

13 Claims, 7 Drawing Sheets

ELECTRICAL CONNECTOR HAVING REINFORCEMENT MEMBER ATTACHED TO HOUSING

BACKGROUND OF THE INVENTION

1. Field of the Invention

The present invention relates to an electrical connector, and particularly to a surface-mounted connector, such as a ball-grid array connector ("BGA connector"), having a reinforcement member attached to the housing that prevents distortion of the housing.

2. Description of the Prior Art

Surface-mounted connectors, such as BGA connectors, are widely used in electrically connecting electronic packages, such as Land Grid Array (LGA) Central Processing Units (CPU), with circuit substrate, such as printed circuit boards (PCB).

Referring to FIG. 1, a conventional BGA connector 100 for electrically connecting a CPU (not shown) with a PCB (not shown) is illustrated. The connector 100 comprises an insulative housing 10 and a multiplicity of terminals 20 received in the housing 10. The housing 10 defines a multiplicity of passageways 111 therethrough for receiving a corresponding number of terminals 20 therein, and comprises a lower surface 11 for being mounted to the PCB and an upper surface 12 for supporting the CPU.

Each terminal 20 comprises a flat soldering portion 21 extending beyond the lower surface 11 of the housing 10 for electrically connecting with the PCB and a top spring arm 22 with a contacting portion 221 extending beyond the upper surface 12 of the housing 10 for electrically connecting with the CPU at a free end thereof.

Each terminal 20 connects with the PCB by heating a corresponding solder ball (not shown) to its melting point, the molten solder ball subsequently cools and rehardens to form solder connections between the terminal 20 and the PCB, thus the connector 100 makes a good connection between the CPU and the PCB. However, when the solder balls are heated, the changes of the temperature around the housing 10 can easily make the bottom surface 11 of the housing 10 distorted, which make some of the solder balls can not connect with the PCB, thereby make the connector 100 disconnected from the PCB.

In view of the above, a new electrical connector that overcomes the above-mentioned disadvantages is desired.

SUMMARY OF THE INVENTION

Accordingly, an object of the present invention is to provide an electrical connector having a reinforcement member attached to the housing capable of preventing the distortion of the housing when heated.

To fulfill the above-mentioned object, an electrical connector used for electrically connecting an electronic package with a circuit substrate in accordance with a preferred embodiment of the present invention, comprises an insulative housing, a plurality of terminals and a reinforcement member. The housing comprising an upper surface for receiving the CPU and an opposite bottom surface for soldering to the PCB. The upper surface defines a multiplicity of passageways impenetrate to the bottom surface for receiving the terminals. The terminals each comprises a soldering portion extending beyond the bottom surface of the insulative housing adapted for electrically connecting the PCB, a spring arm with a mating portion extending beyond the upper surface of the insulative housing adapted for electrically connecting the CPU at a free end thereof. The reinforcement member with a different material from that of the insulative housing attached to the bottom surface of the insulative housing, when heated, the reinforcement member produces no distortion that can reinforce the insulative housing to prevent the distortion of the insulative housing.

Other objects, advantages and novel features of the invention will become more apparent from the following detailed description when taken in conjunction with the accompanying drawings.

DETAILED DESCRIPTION OF THE PREFERRED EMBODIMENT OF THE INVENTION

Reference will now be made to the drawings to describe the present invention in detail.

FIGS. 2 to 5 depict the first embodiment of the present invention. In this embodiment, an electrical connector 200 is used for electrically connecting an electronic package, such as a land grid array (LGA) central processing unit (CPU) (not shown), with a circuit substrate, such as a printed circuit board (PCB) (not shown). The connector 200 comprises an insulative housing 3, a plurality of terminals 4 received in the housing 3 and a reinforcement member 5. In the first embodiment, for simplification, only one section of the whole insulative housing 3, terminals 4 and reinforcement member 5 are shown.

Figure 1:
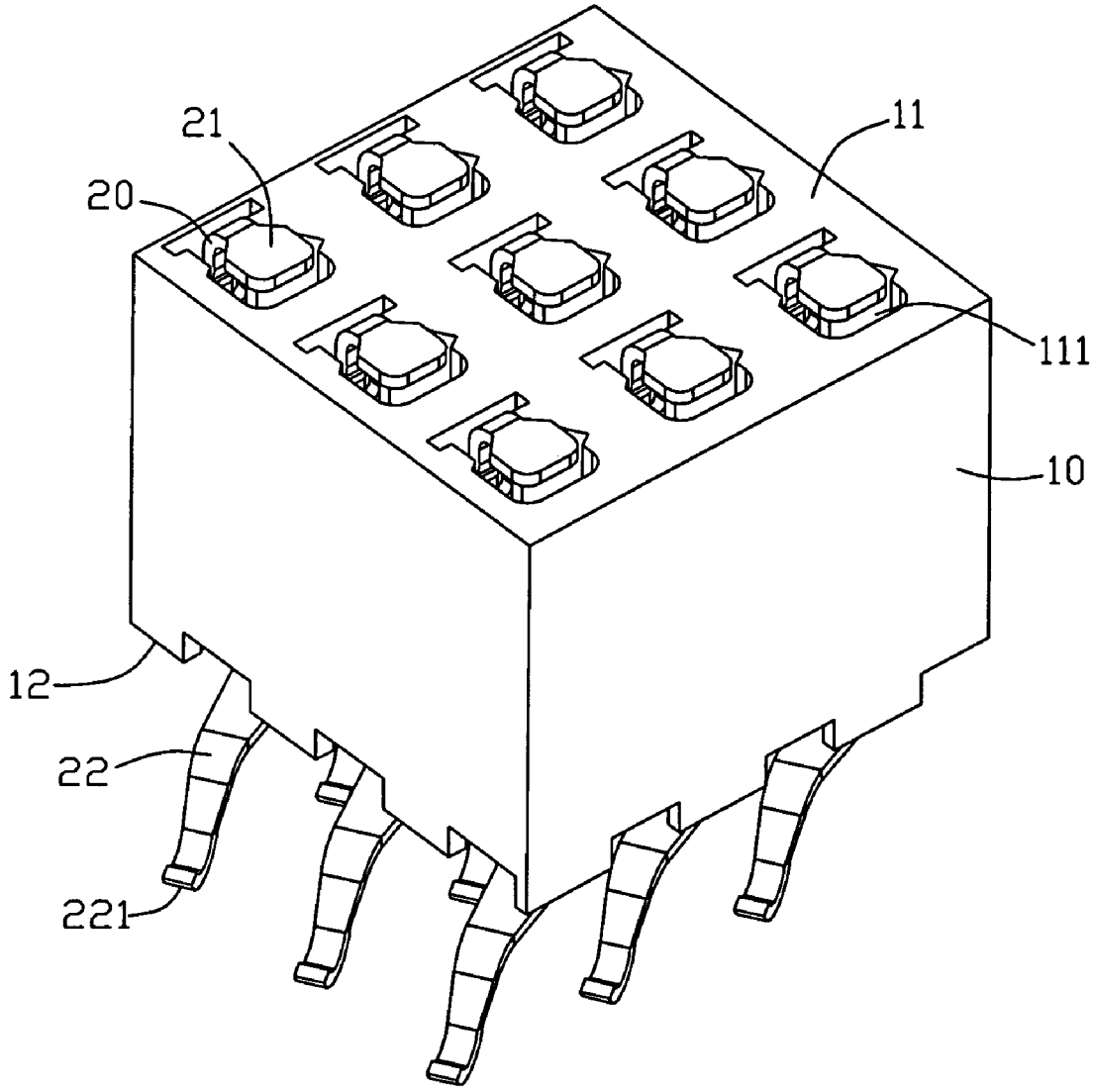
FIG. 1 (PRIOR ART)
FIG. 1 is a bottom view of a conventional connector.
Figure 2:
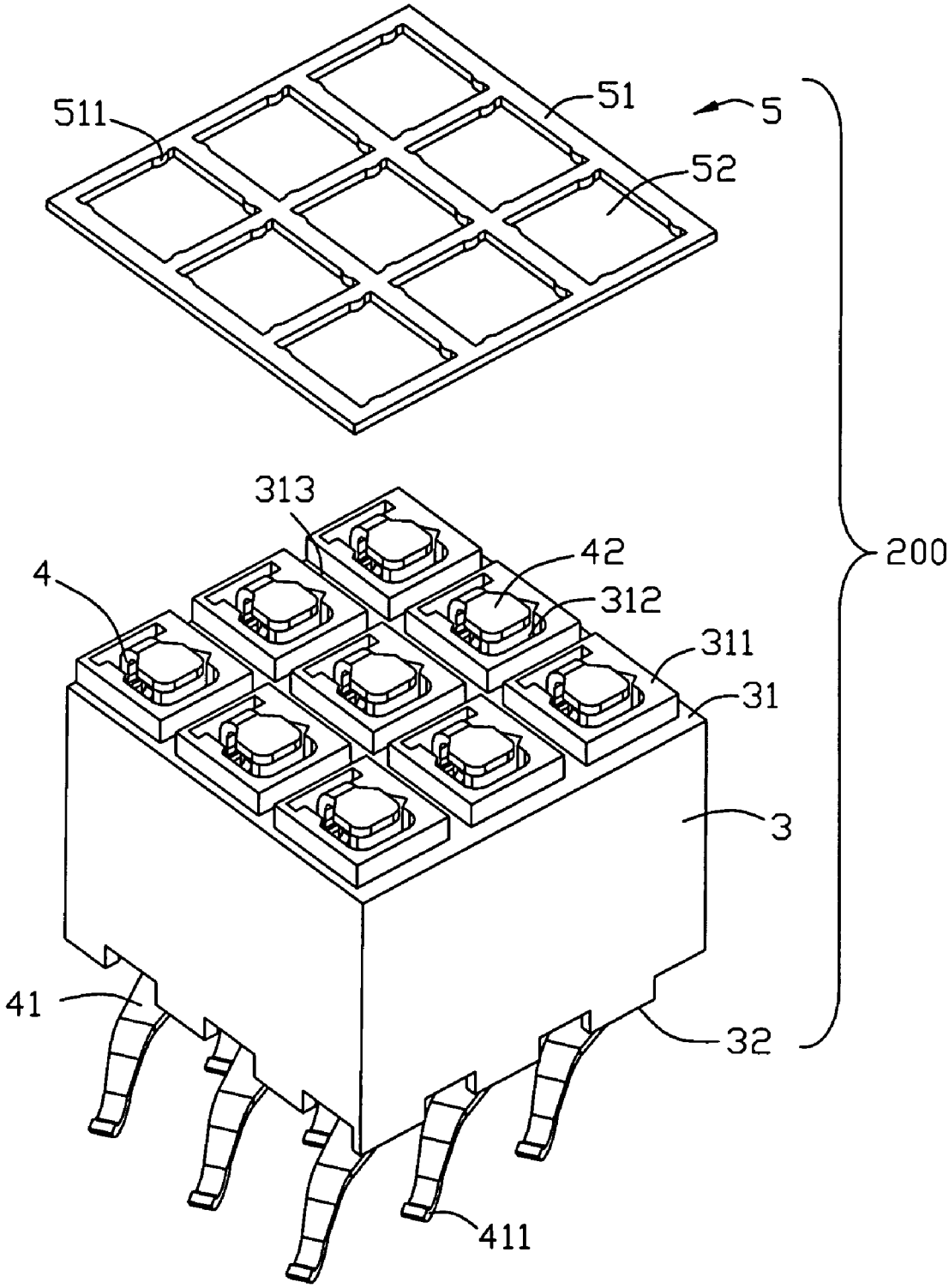
FIG. 2 is partially exploded view of the first embodiment of the present invention, showing the reinforcement member disassembled from the insulative housing.

Referring to FIG. 2, the housing 3 comprises a bottom surface 31 for being mounted on the PCB, an upper surface 32 for supporting the CPU and a plurality of pedestals 311 projecting from the bottom surface 31 and arranged in a matrix. The upper surface 32 defines a multiplicity of passageways 312 impenetrate to the pedestals 311 for receiving the terminals 4 therein. The pedestal 311 is formed with a square figure (also the pedestal 311 can be formed to circular and other figures) and each spaced apart from adjacent ones of the pedestals 311, so that the pedestals 311 and the bottom surface 31 of the housing 3 define channels 313. In this embodiment, the number of the pedestals 311 is equal to the number of the passageways 312, that is to say, one pedestal 311 projects from the bottom surface 31 of the housing 3 according to one passageway 312, however, two or more pedestals 311 can be combined to one pedestal 311 in the real application.

The terminal 4 comprises a soldering portion 42 extending beyond the pedestals 311 of the insulative housing 3 adapted for electrically connecting the PCB, and optimally via a corresponding solder ball (not shown) which is attached on an underside of the soldering portion, a spring arm 41 with a curved mating portion 411 extending beyond the upper surface 32 of the insulative housing 3 adapted for electrically connecting the CPU at a free end thereof.

Figure 3:
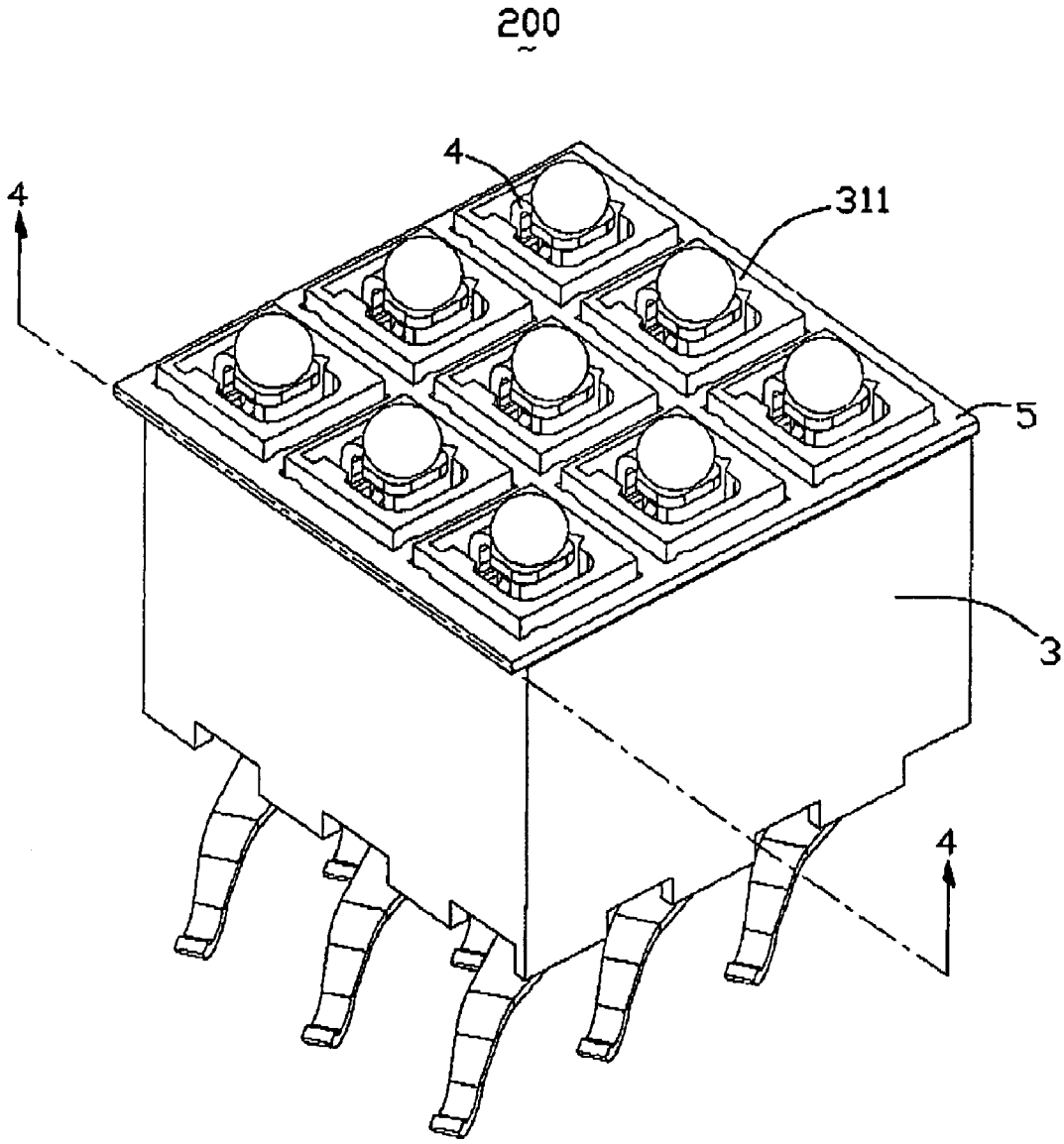
FIG. 3 is an assembled view of the first embodiment of the present invention, showing the reinforcement member attached to the insulative housing.
Figure 4:
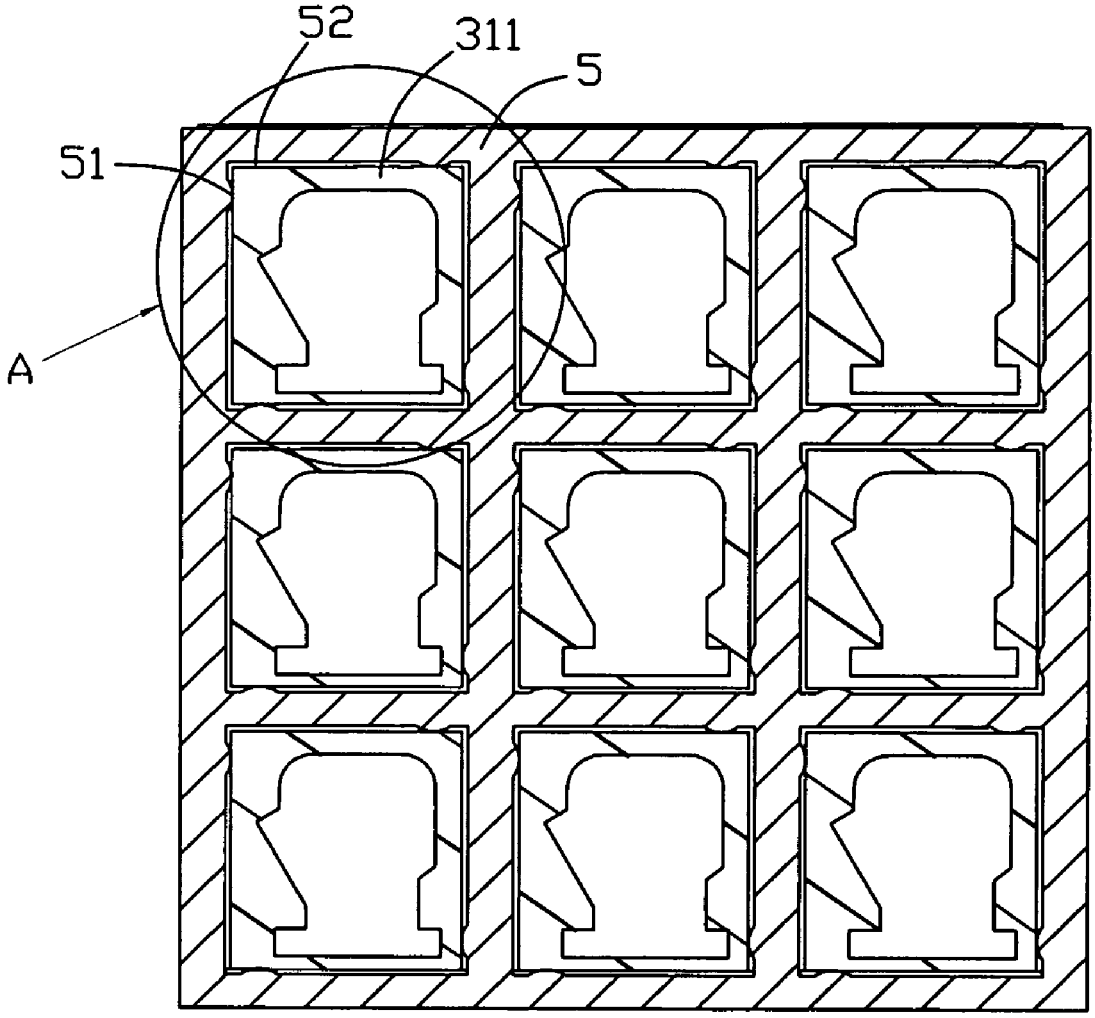
FIG. 4 is a cross-sectional view of FIG. 3 taken along line 4-4, with the terminals not assembled to the insulative housing to show how the reinforcement member interferences with the housing.
Figure 5:
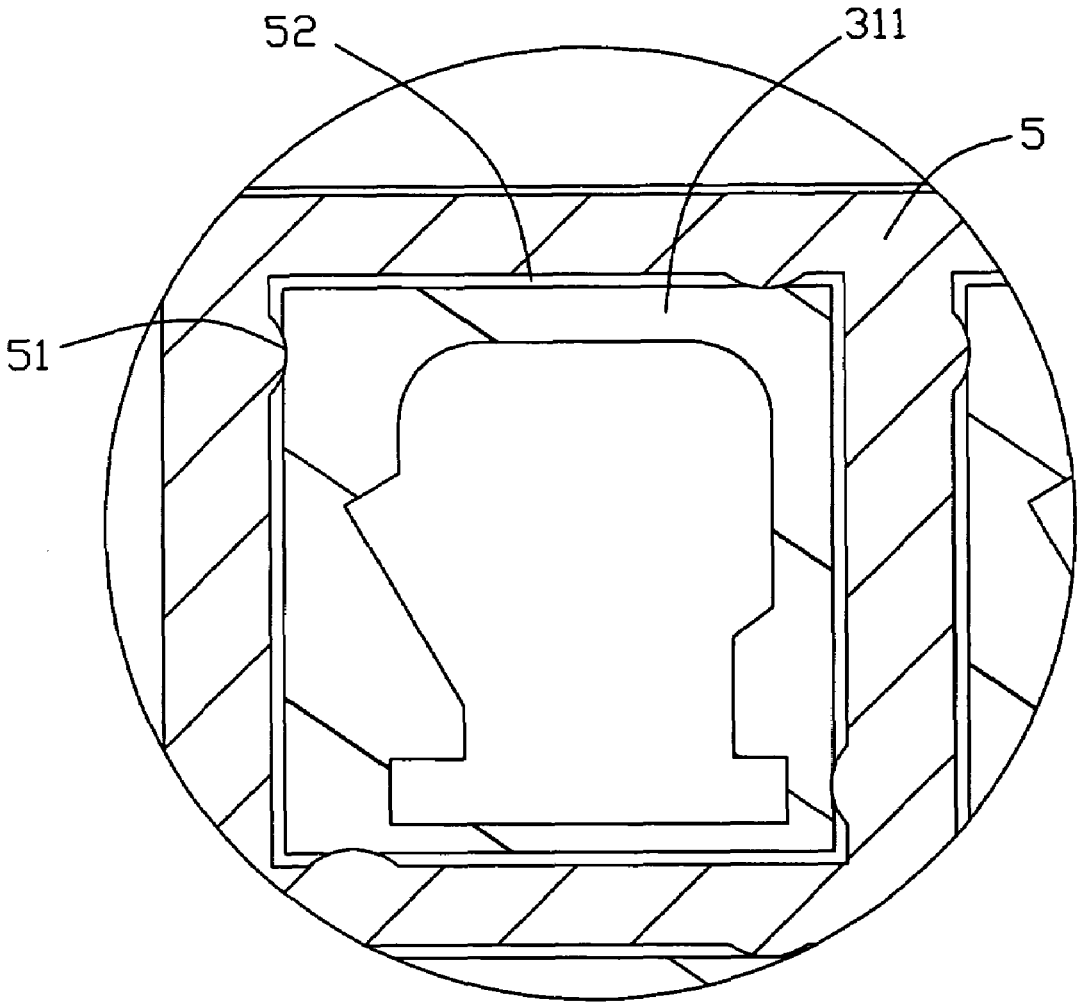
FIG. 5 is a magnified view of the area designated "A" in FIG. 4.

The reinforcement member 5 is made of material different from that of the housing, in this embodiment, it is made of metal. The reinforcement member 5 is formed to a griding shape with a plurality of crossbands 51, so that the reinforcement member 5 includes a plurality of recesses 52, the crossbands 51 defines a plurality of barbs 511 extending into the recesses 52. Referring to FIGS. 3 to 5, the recess 52 has a size little larger than that of the pedestal 311, so when the reinforcement member 5 is assembled to the bottom surface 31 of the insulative housing 3, press the crossbands 51 to make it located in the channels 313 with the barbs 511 interfering with the sides of the pedestals 311, thus, the reinforcement member 5 can be firmly attached the insulative housing 3.

Figure 6:
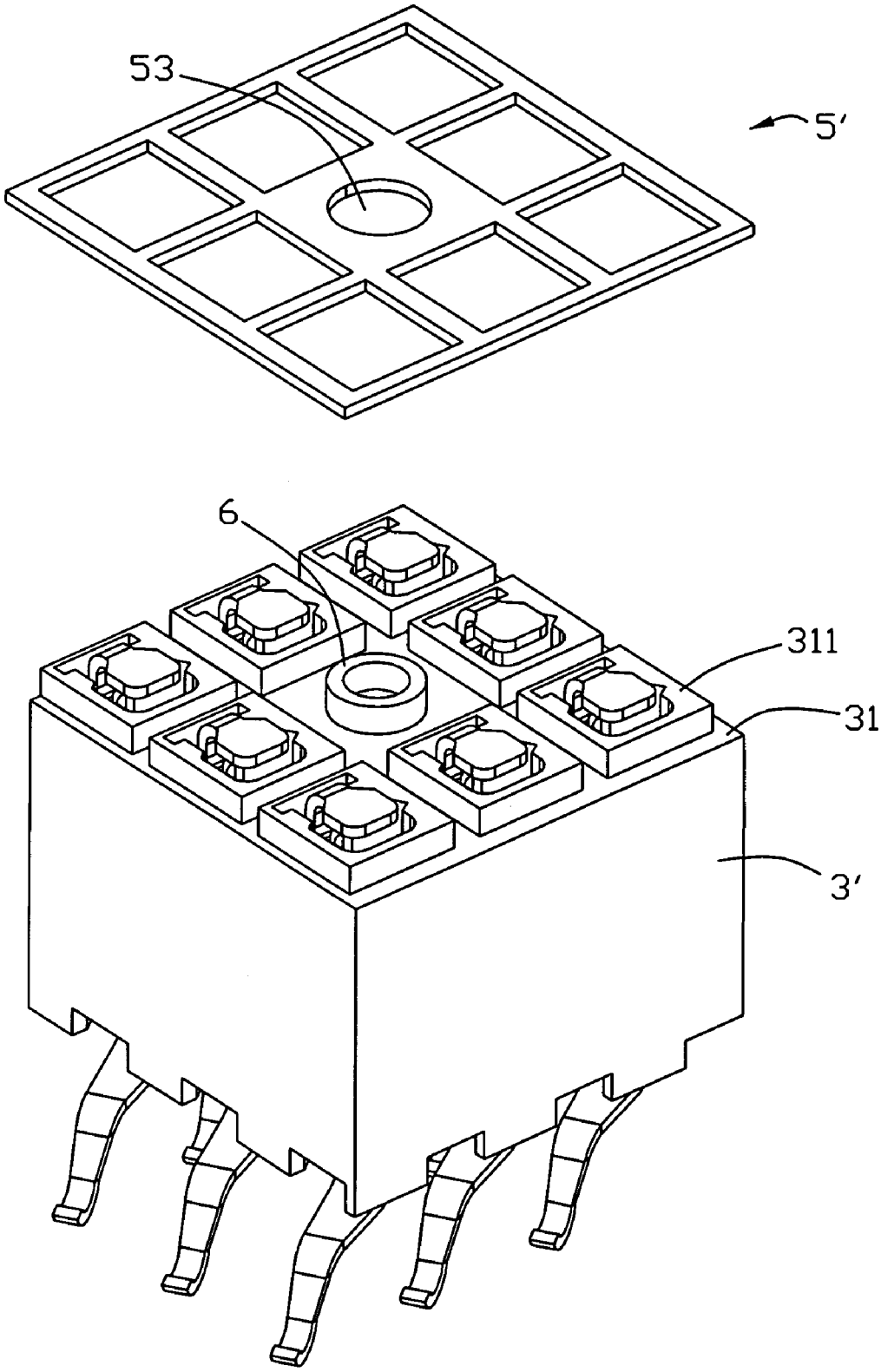
FIG. 6 is partially exploded view of the second embodiment of the present invention, showing the reinforcement member disassembled from the insulative housing.
Figure 7:
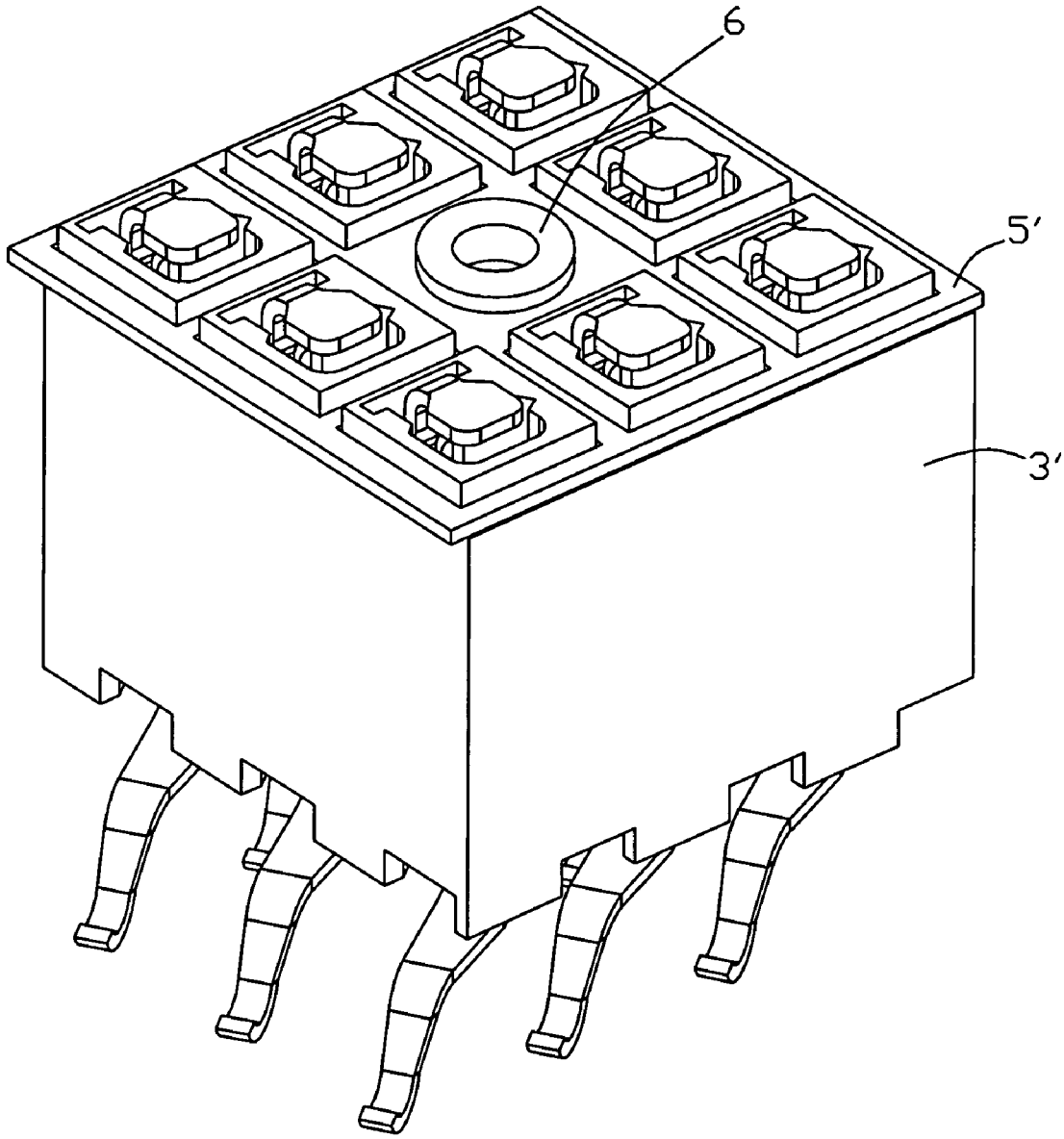
FIG. 7 is an assembled view of the second embodiment of the present invention, showing the reinforcement member attached to the insulative housing.

FIGS. 6 to 7 depict the second embodiment of the present invention. The differences between the second embodiment and the first embodiment of the present invention is the way of how to assemble the reinforcement member 5' to the housing 3'. In this embodiment, the housing 3' defines a plurality of posts 6 among the pedestals 311 with an insert-molding mold and the reinforcement member 5' defines a plurality of holes 53 according to the posts 6, the size of the hole 53 is a little larger than that of the post 6, in this embodiment, the reinforcement member 5' has no barbs 511 as shown in the first embodiment of the present invention. Since only one section of the insulative 3' and the reinforcement member 5' are shown, only one hole 53 and one post 6 are shown for illustration. When the reinforcement member 5' assembled to the insulative housing 3', use a tool to rivet the post 6 to make it larger than the hole 53, thus make the reinforcement member 5' firmly attached to the insulative housing 3'.

In the above detailed description, the material of the reinforcement member is different from the insulative housing, when heated, the reinforcement member will not distort together with the insulative housing, thus can reinforce the insulative housing for preventing the distortion of the insulative housing.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector adapted for connecting an electronic package with a circuit substrate, comprising:

an insulative housing comprising an upper surface adapted for receiving the electronic package and an opposite bottom surface adapted for being mounted to the circuit substrate, the upper surface defining a multiplicity of passageways impenetrate to the bottom surface, the insulative housing defining a grid of channels at the bottom surface;

a plurality of terminals received in the passageways respectively, each terminal comprising a soldering portion extending beyond the bottom surface of the insulative housing adapted for electrically connecting the circuit substrate, a spring arm with a mating portion extending beyond the upper surface of the insulative housing adapted for electrically connecting said electronic package at a free end thereof; and a flat reinforcement member disposed within the channels of the insulative housing and defining a plurality of recesses corresponding to the passageways of the insulative housing to permit the soldering portions of the terminals extending therethrough.

2. The electrical connector as claimed in claim 1, wherein the material of the reinforcement member is different from that of the insulative housing.

3. The electrical connector as claimed in claim 2, wherein the reinforcement member is made of metal.

4. The electrical connector as claimed in claim 1, wherein insulative housing includes a plurality of pedestals projecting from the bottom surface.

5. The electrical connector as claimed in claim 4, wherein the soldering portions of the terminals extend beyond the pedestals for being soldered to the circuit substrate.

6. The electrical connector as claimed in claim 5, wherein each pedestal is spaced apart from adjacent pedestals.

7. The electrical connector as claimed in claim 6, wherein the channels are formed by the pedestals and the bottom surface of the housing.

8. The electrical connector as claimed in claim 7, wherein the reinforcement member is formed to a griding shape with a plurality of crossbands, and wherein the crossbands are located in the channels.

9. The electrical connector as claimed in claim 8, wherein the crossband defines plurality of barbs extending to the recesses interfered with the pedestals to make the reinforcement member fixed on the insulative housing firmly.

10. The electrical connector as claimed in claim 1, wherein the electrical connector comprises post fixed in the insulative housing in an insert-molding mode.

11. The electrical connector as claimed in claim 10, wherein the post extends beyond the bottom surface of the insulative housing.

12. The electrical connector as claimed in claim 11, wherein the reinforcement member defines a plurality of holes according to the posts.

13. The electrical connector as claimed in claim 12, wherein the post can be pressed to be larger than the hole of the reinforcement member to make the reinforcement fixed on the insulative housing firmly.

* * * * *